United States Patent [19]

Bunch, Jr.

[11] Patent Number: 4,558,644

[45] Date of Patent: Dec. 17, 1985

[54] PRINTING PRESS WITH PARALLEL TRANSVERSE WEAKENING LINE MECHANISM

[75] Inventor: Ernest B. Bunch, Jr., Phoenix, Ariz.

[73] Assignee: B. Bunch Company, Inc., Peoria, Ariz.

[21] Appl. No.: 687,268

[22] Filed: Dec. 28, 1984

[51] Int. Cl.[4] ..... B41F 13/36

[52] U.S. Cl. ..... 101/226; 493/324

[58] Field of Search ..... 101/216, 226, 227; 493/324, 325, 356

[56] References Cited

U.S. PATENT DOCUMENTS

| | | | |
|---|---|---|---|
| 3,848,320 | 11/1974 | Davidson, Jr. | 101/229 |
| 3,972,283 | 8/1976 | Jennings | 101/226 |
| 4,098,185 | 7/1978 | Davidson, Jr. | 101/148 |
| 4,205,836 | 6/1980 | Nystrand | 493/357 |
| 4,411,195 | 10/1983 | Tailleux et al. | 101/226 |
| 4,507,109 | 3/1985 | Meschi | 493/356 |
| 4,512,256 | 4/1985 | Schriber et al. | 101/226 |

*Primary Examiner*—E. H. Eickholt

*Attorney, Agent, or Firm*—Drummond & Nissle

[57] ABSTRACT

An improved printing press. The printing press forms transverse lines of weakening at spaced intervals along a continuous strip of paper after the paper has been imprinted with a repeating business format. The press then creases the strip of paper along the lines of weakening formed therein.

1 Claim, 7 Drawing Figures

FIG. 1
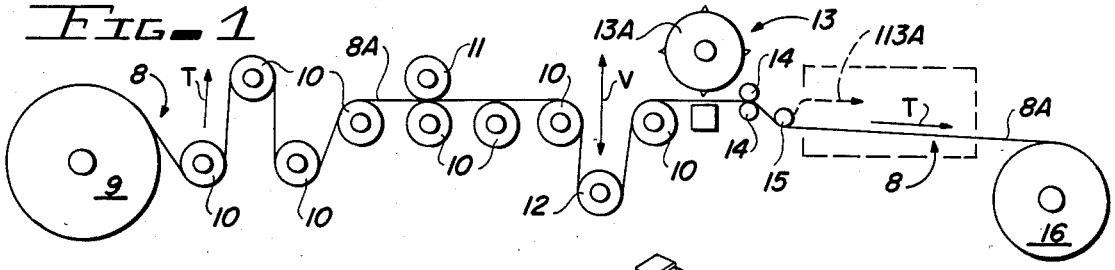
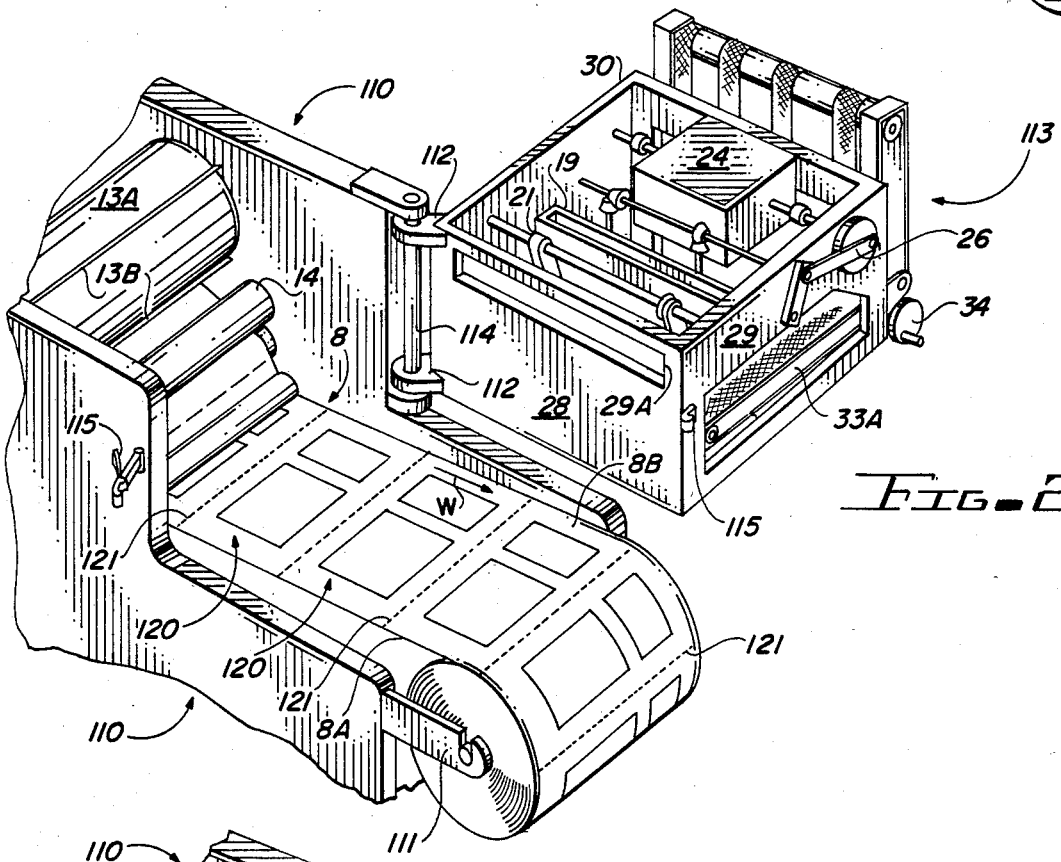
FIG. 2
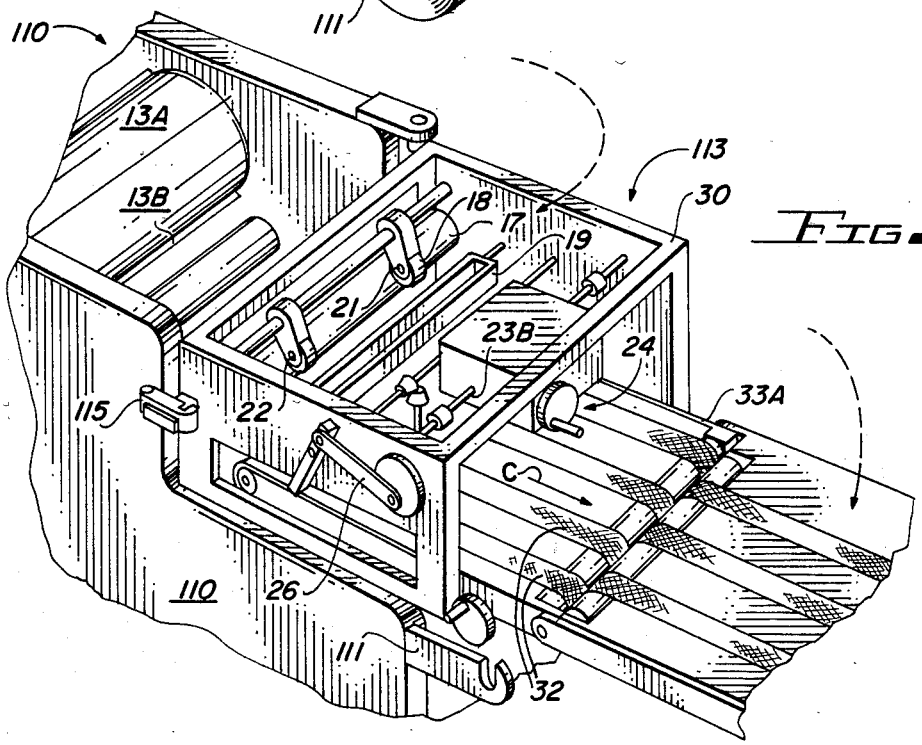
FIG. 3

FIG. 6
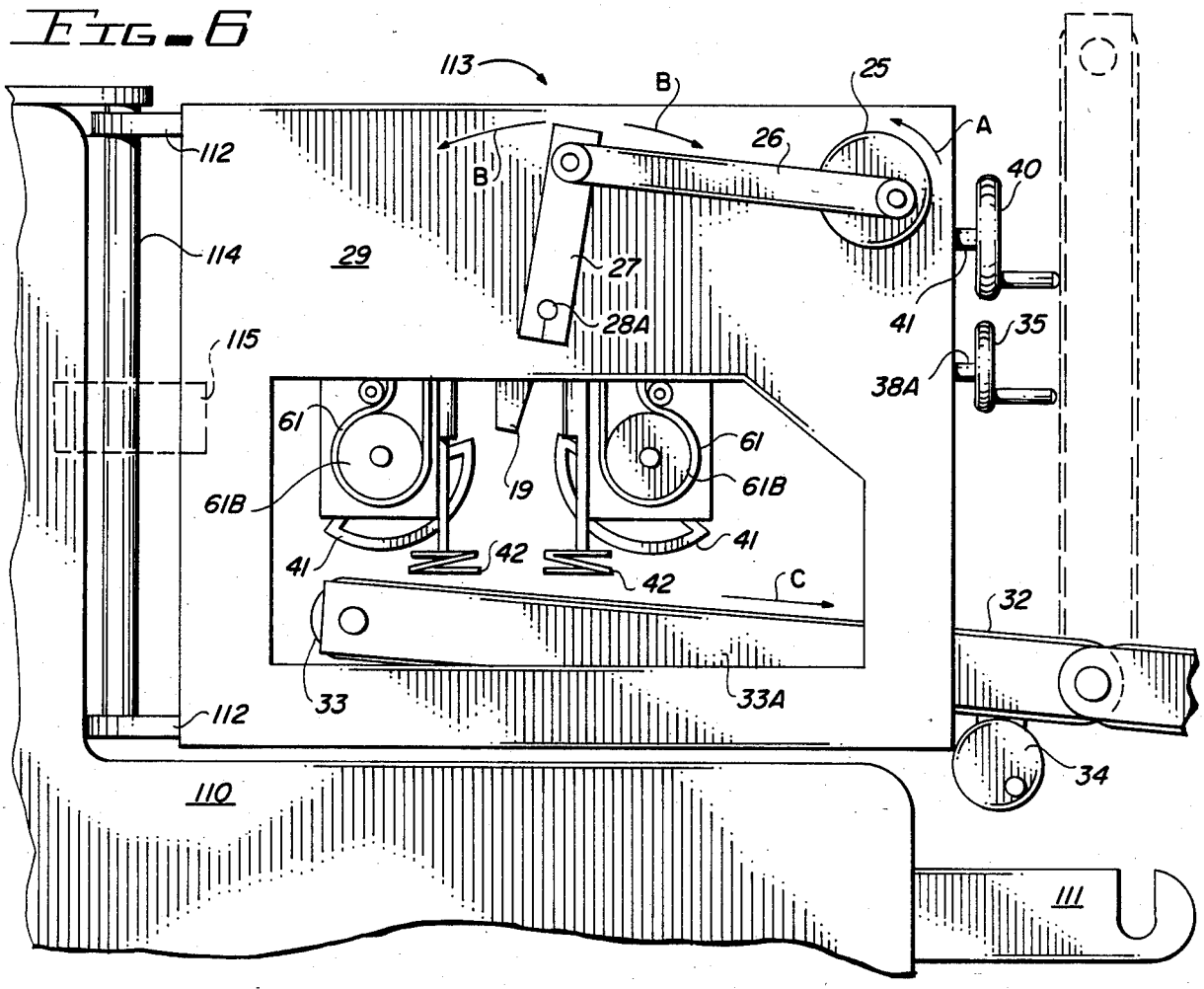
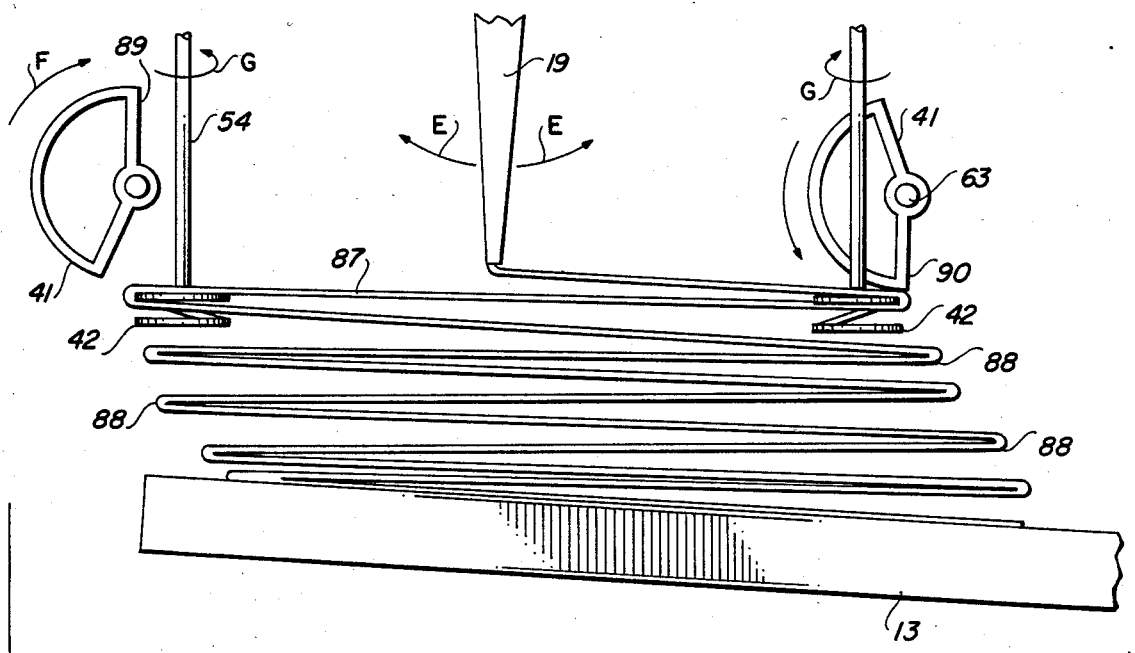
FIG. 7

PRINTING PRESS WITH PARALLEL TRANSVERSE WEAKENING LINE MECHANISM

This invention relates to improved apparatus for imprinting a continuous strip of paper.

More particularly, the invention concerns improved printing apparatus for forming transverse lines of weakening at spaced intervals along a continuous strip of paper after the paper has been imprinted along its length with a repeating business format, each transverse line of weakening generally being formed between an adjacent pair of imprinted business formats.

In another respect, the invention concerns improved printing apparatus of the type described which can be readily adapted to permit imprinted paper produced by the apparatus either to be directed onto a take-up storage roller or to be processed by auxiliary apparatus which creases the continuous strip of paper along lines of weakening formed therein.

Accordingly, it would be highly desirable to provide improved printing apparatus which would permit the relative position of lines of weakening and imprinted business formats to be readily synchronized and which would permit an imprinted strip of continuous form stationery to be creased along lines of weakening formed therealong without requiring that the stationery be stored on a take-up roller and transported to auxiliary creasing equipment.

Therefore, it is a principal object of the invention to provide improved apparatus for imprinting and forming lines of weakening in a strip of paper to produce continuous form stationery.

Another object of the invention is to provide improved printing apparatus which permits the position of lines of weakening with respect to imprinted business formats on a strip of paper to be synchronized and which permits the simultaneous synchronization of apparatus for imprinting and forming transverse lines of weakening in a strip of paper with auxiliary apparatus for creasing the strip of continuous form stationery along the transverse lines of weakening.

Apparatus for repeatedly imprinting a business format on a continuous strip of paper at fixed equal intervals therealong is well known in the art. After a business format is repeatedly imprinted along a strip of paper, transverse lines of weakening are formed at spaced intervals along the strip of paper, each line of weakening being formed intermediate two successive business formats imprinted on the paper strip. The strip of paper is then subsequently folded along the lines of weakening. Various problems are associated with the imprinting of, formation of lines of weakening in, and folding of continuous form stationery. In particular, when a continuous strip of paper travels through a printing press, different portions of the paper stretch at differing rates, causing the position of each imprinted business form to advance or retard, i.e., to "travel", with respect to lines of weakening being formed in the paper. As a result, lines of weakening may be formed in the paper at a position too near or too far from an imprinted business format. Another problem associated with the manufacture of continuous form stationery is that after a strip of paper is imprinted and transverse lines of weakening are formed in the paper, the paper strip must be stored on a take-up roller which is removed from the printing apparatus and transported to auxiliary equipment to crease the paper along its lines of weakening.

These and other and further and more specific objects and advantages of the invention will be apparent to those skilled in the art from the following detailed description thereof, taken in conjunction with the drawings, in which:

FIG. 1 is a schematic view of printing apparatus constructed in accordance with the principles of the invention;

FIG. 2 is a perspective view of a portion of the apparatus of FIG. 1 illustrating further construction details thereof;

FIG. 3 is a perspective view of the apparatus of FIG. 3 illustrating the mode of operation thereof;

FIG. 6 is a left side elevation view of the creasing apparatus of FIG. 3; and, FIG. 7 is a schematic view of the creasing apparatus of FIG. 6 showing the interrelationship between the paper creasing mechanisms thereof.

Figure 4:
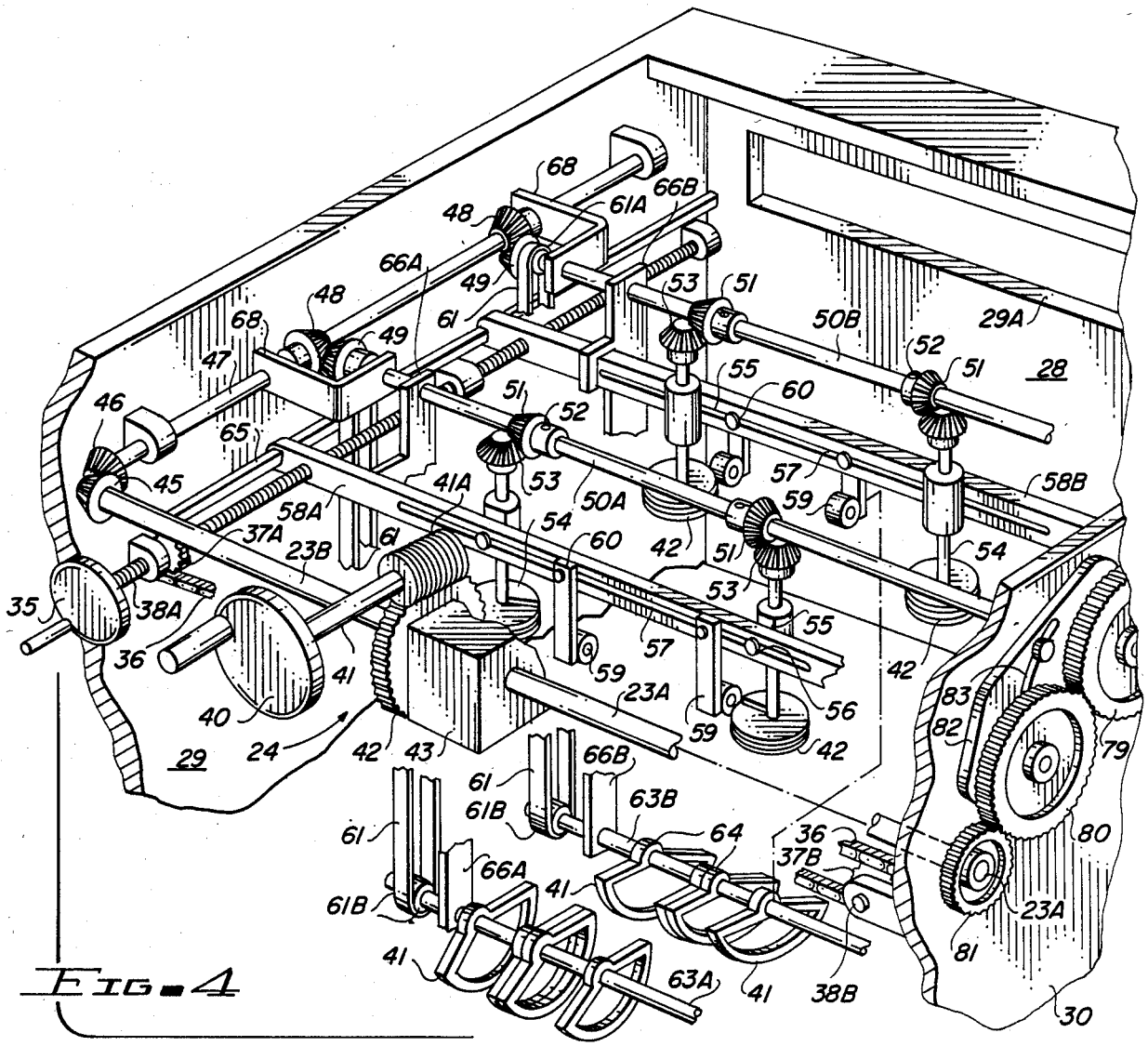
FIG. 4 is an enlarged partial perspective view of the continuous stationery form creasing apparatus of Fig. 3 illustrating details of the paper folding mechanism and associated drive train.

Briefly, in accordance with the presently preferred embodiment of my invention, I provide improved apparatus for imprinting an elongate strip of paper moving along a path of travel through the apparatus. The paper strip includes a pair of parallel elongate peripheral edges. The improved printing apparatus includes primary frame means; a roll of paper rotatably mounted on the frame means to supply the strip of paper moving through the apparatus; at least one drum rotatably mounted on the frame means to supply the strip of paper moving through the apparatus; at least one drum rotatably mounted on a frame means for contacting and imprinting the strip of paper moving through the apparatus; roller means rotatably mounted on the frame means and adapted to contact and form transverse, parallel lines of weakening at spaced intervals along the paper strip moving through the apparatus; a takeup roller for receiving the paper strip after the strip has contacted and moved past the imprinting drum and the roller means; a plurality of guide rollers rotatably mounted on the frame means and contacted by the strip of paper moving through the apparatus, the guide rollers, imprinting drum and roller means generally defining the path of travel of the strip of paper from the supply roll through the apparatus, one of the guide rollers being positioned along the path of travel intermediate the roller means and take-up roller, the paper strip moving through the apparatus along the path of travel within an envelope generally bounded by a pair of imaginary vertical parallel planes each intersecting one of the elongate peripheral edges of the paper strip; and, secondary frame means operatively associated with the primary frame means. The secondary frame means includes an oscillating chute mounted on the secondary frame means for alternately distributing at least some of the lines of weakening in the paper strip in substantially opposite directions; a feed roller carried on the secondary frame means for dispensing the continuous strip of paper into the oscillating chute, and, folding means carried on the secondary frame means and operatively associated with the oscillating chute for urging the paper distributed by the chute into a folded condition. The folding means includes spirals being independently adjustable prior to the operation of the apparatus; and, beaters for periodically tamping the paper distributed by the chute, the beaters assisting in the folding and positioning of the paper and being independently adjustable prior to the operation of the apparatus. The spirals and beaters move in synchronous relationship with the chute during the operation thereof. A support surface is mounted on the apparatus to receive paper dispensed by the spirals and beaters. The secondary frame means also includes paper stops mounted on the secondary frame means and positioned above the support surface, each of the paper stops having at least one upstanding face for contacting and preventing the lateral travel of creased edges of paper distributed by the chute. First gear train means is carried on the primary frame means for transmitting motive power to at least one of the group consisting of the guide rollers, the take-up roller, the imprinting drum, and the roller means mounted on the primary frame means to draw the paper strip from the supply roller through the apparatus and along the path of travel. Power means are provided to drive the first gear train means. Seond gear train means are carried on the secondary frame means to drive and transmit motive power to the feed roller, oscillating chute and folding means such that generally synchronized movement therein between is maintained, a portion of the gear train means actuating the chute and folding means without actuating the feed roller. Means are provided to drive the second gear train means. Means are also carried on the secondary frame means to simultaneously adjust the oscillating chute and folding means in relation to the feed roller while maintaining the generally synchronous movement between the chute and folding means. The adjustment means includes at least one driven shaft positioned along the second gear train means and transmitting motive power to the portion of the second gear train means actuating the oscillating chute and the folding means, the drive shaft having a first segment and a second segment; and, a differential unit positioned between and interconnecting the first shaft segment and second shaft segment for rotating and advancing and retarding the first shaft with respect to the second shaft so that the synchronous movement of the oscillating chute and the folding means may be adjusted in relation to the feed roller when the second gear train means is driving the feed roller, oscillating chute, and folding means. The secondary frame means is connected to the primary frame means for movement between at least two operative positions, a first operative position with the feed roller generally parallel to guide rollers, supply roll, and take-up roller, and positioned to receive the paper strip from the guide roller positioned intermediate the roller means and the take-up roller such that the paper strip received by the feed roller generally lies within the envelope bounded by the first and second parallel imaginary planes; and, a second operative position with the feed roller and secondary frame means generally displaced to a position outside of the envelope bounded by the first and second parallel imaginary planes. The paper strip moving through the apparatus is directed from the guide roller positioned intermediate the roller means and take-up roller to the feed roller and through the chute and folding means when the secondary frame means is in the first operative position. When the secondary frame means is in its second operative position, the paper strip moving through the apparatus is directed to the take-up roller from the guide roller positioned intermediate the roller means and the take-up roller.

Turning now to the drawings, which depict the presently preferred embodiments and best mode of the invention for the purpose of illustrating the practice thereof and not be way of limitation of the scope of the invention and in which like reference characters identify corresponding parts in the several views, FIG. 1 is a schematic view depicting the general arrangement of the elements including paper supply roll 9, guide rollers 10, imprinting drum 11, variator roller 12, perforator roller means 13, guide rollers 14, guide roller 15 and take-up roll 16. Perforator means 13 includes roller 13A provided with perforating fins 13B. Supply roll 9, guide rollers 10, imprinting drum 11, variator roller 12, perforator roller means 13, guide rollers 14, guide roller 15 and takeup roll 16. Perforator means 13 includes roller 13A provided with perforating fins 13B. Supply roll 9, guide rollers 10, drum 11, variator roller 12, perforator roller 13A, guide rollers 14, 15 and take-up roll 16 are rotatably carried in a framework 110 partially illustrated in FIG. 2. Guide rollers 10, drum 11, variator roller 12, perforator roller 13A and guide rollers 14, 15 generally define the path of travel of paper strip 8 through the printing apparatus of FIGS. 1–7. As illustrated in FIG. 2, paper strip 8 includes elongate parallel peripheral edges 8A and 8B. A pair of opposed parallel imaginary vertical planes pass through edges 8A and 8B of the strip 8 of paper traveling through the printing apparatus of FIGS. 1–7. In FIG. 1, the imaginary vertical plane passing through edge 8A of strip 8 is parallel to and lies in the plane of the sheet of paper of the drawings. When strip 8 is moving through the apparatus of FIG. 1, strip 8 lies in an envelope bounded by the pair of imaginary vertical parallel planes passing through edges 8A and 8B of strip 8.

The axle of take-up roll 16 is rotatably supported on frame 110 by a pair of support arms 111, one of which is visible in FIG. 2. Hinge members 112 are fixedly attached to creasing apparatus 113 and pivot about vertically disposed rod 114 fixedly secured to frame 110. When apparatus 113 is displaced to the operative position of FIG. 2, the paper strip 8 passing through the apparatus of FIG. 1 is directed from guide roller 15 to take-up roll 16. When apparatus 113 is pivoted about rod 114 to the operative position of FIG. 3, paper strip 8 passing through the apparatus is directed from guide roller 15 to the feed roller 17 of apparatus 113 as indicated by dashed line 113A in FIG. 1, and take-up roll 16 is not utilized. Latch mechanism 115 secures apparatus 113 in the operative position of FIG. 3.

Figure 5:
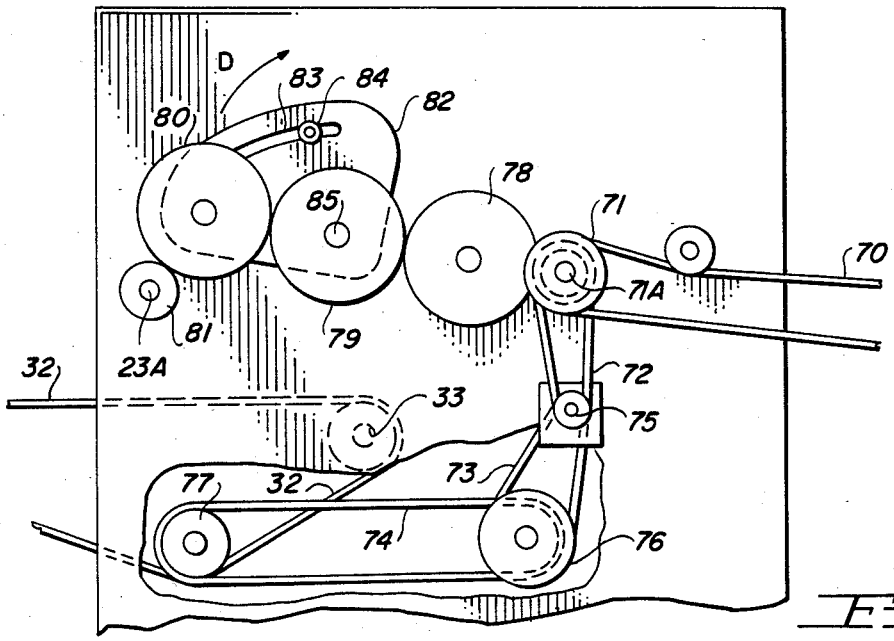
FIG. 5 is a schematic drawing of the right hand side of the creasing apparatus of FIG. 4 illustrating the drive mechanism which activates the paper dispensing roller and further transmits motive power to that portion of the gear train activating the paper folding and distribution mechanisms.

The rectangular frame of apparatus 113 includes panel members 28, 29, 30. When paper strip 8 is directed from guide roller 15 into apparatus 113, strip 8 passes through rectangular opening 29A and is drawn by dispensing roller 17 beneath roller guides 18 and directed into chute 19. Dispensing roller 17 is carried on axle 71A (not visible in FIG. 3) journalled for rotation in panels 29 and 30. The axle is rotated by the gear train of the apparatus which is illustrated in FIG. 5 and discussed below. Roller guides 18 are secured to rod 20 and sleeves 21 provided with axles 22.

A pair of drive shafts 23A and 23B are integrated with a differential mechanism which is generally indicated by reference character 24. Shaft 23B rotates gear 25 in the direction of arrow A (FIG. 6) causing link 26 to reciprocate arm 27 in the directions of arrows B. Arm 27 is fixedly secured to shaft 28A which is attached to chute 19 and journalled for rotation in panel 29. An identical shaft 28B is affixed to the opposite side of chute 19 and is journalled for rotation in panel 30.

Transverse lines of weakening along a continuous strip of paper entering chute 19 are distributed by the chute in substantially opposite directions as chute 19 oscillates and, as later described, the paper is compressed and folded by "beaters" and "spirals" (not visible in FIGS. 2 and 3). Continuous moving belts 32 carried by roller 33 transport folded paper away from the beaters and spirals in the direction of arrow C. The slope of conveyor table 33A is adjusted by turning handle 34.

Threaded shafts 38A and 38B carry sprockets 37A and 37B which engage continuous chain 36. Turning handle 35 rotates shaft 38A causing sprocket 37A to engage and turn continuous chain 36 so that sprocket 37B and shaft 38B simultaneously rotate. Rotation of shafts 38A and 38B horizontally adjusts the position of the beaters, spirals and paper stops. Shaft 38B is identical and parallel to shaft 38A and extends along the inside of panel 30.

Differential mechanism 24 includes handle 40 for rotating shaft 41 which is provided with worm gear 41A engaging ring gear 42 fixedly attached to spider 43. As would be apparent to those skilled in the art, handle 40 may be turned while drive shafts 23A and 23B are rotating or are motionless. Turning handle 40 rotates and advances or retards a particular point on shaft 23B with respect to a point on shaft 23A. When handle 40 is not used to adjust the relative position of shafts 23A and 23B with respect to one another, the differential mechanism 24 functions as an idler, allowing each shaft 23A, 23B to simultaneously rotate at an identical rpm.

FIGS. 4–7 illustrate the interrelation of the beaters 41, spirals 42, chute 19 and gear train of the apparatus. As shown in FIG. 4, drive shaft 23B is provided with pinion gear 45 which drives gear 46 to rotate shaft 47 and bevel gears 48 mounted thereon. Gears 48 drive bevel gears 49 to rotate shafts 50A and 50B and to rotate gears 51 which are fixedly detachably fixedly secured to shafts 50A, 50B by set screws 52. Pinion gears 51 turn beveled gears 53 to rotate shafts 54 and spirals 42. Shafts 54 are journalled for rotation in sleeves 55 which are provided with set screws 56 for transversely adjusting the position of spirals 42 along slots 57 in support bars 58A, 58B. Paper stops 59 are also fixedly adjustably attached to bars 58A, 58B by setscrews 60.

When shafts 50A, 50B are rotated, continuous belts 61 mounted on rollers 61A and 61B affixed to rods 50A, 50B, 63A, 63B turn and simultaneously rotate shafts 63A, 63B on which beaters 41 are adjustably mounted. Set screws 64 permit beaters 41 to be positioned along shafts 63.

When threaded shafts 38A and 38B are rotated by turning handle 35, support bars 58A, 58B slide along horizontal rails 65 attached to the interior of panels 29, 30. In FIG. 4, member 66A interconnects the left hand ends of shaft 50A, bar 58A and rod 63A so that when threaded rod 38 is rotated shaft 50A, bar 58A and rod 63A move in unison. Member 66B interconnects the left hand ends of shaft 50B, bar 58B and rod 63B so that when threaded rod 38A is rotated shaft 50B, bar 58B and rod 63B move in unison. A third member 66C (not visible) interconnects the right hand ends of shaft 50B, bar 58B and rod 63B so that when threaded rod 38B is rotated shaft 50B, bar 58B and rod 63B move in unison. A fourth member 66D (Not visible) interconnects the right hand ends of shaft 50A, bar 58A and rod 63A so that when threaded rod 38B is rotated shaft 50A, bar 58A and rod 63A move in unison. When the position of bars 58A and 58B are adjusted by turning threaded rods 38A and 38B, gears 48 slide along rod 47. L-shaped brackets 68 function to slide pinion gears 48 along rod 47 and to keep pinion gears 48 meshed with gears 49. Chute 19 and feed roller 17 are omitted from FIG. 4 for the sake of clarity.

As shown in FIG. 5, belt 70 actuates gear 71 and provides the motive power to drive the gear train of the apparatus of FIGS. 4–7. Belt 70 is driven by power means (not shown). When apparatus 113 is in the operative position illustrated in FIG. 3, belt 70 is preferably connected to and derives motive power from the printing press gear train which drives certain of rollers 10, drum 11, variator roller 12, roller 13A, guide rollers 14, 15, and take-up roll 16. In FIGS. 2 and 3 the printing press gear train for the guide rollers 10, etc. is carried on the rear surface of frame 110 and is not visible. The power unit providing motive power for the printing press gear train carried on the rear of frame 110 is also positioned behind frame 110 and is not visible. Continuous belts 72, 73 and 74 transmit power to conveyor belts 32 of table 33A via pulley gear 75 and rollers 76, 77. Motive power from gear 71 is transmitted through sector gears 78, 79, and 80 to removable toothed gear 81. Gear 80 is attached to plate 82 having slot 83 formed therein. Plate 82 is pivotally mounted on pin 85. In order to remove gear 81 from shaft 23A, set screw 84 in slot 83 is loosened and gear 80 is upwardly lifted in the direction of arrow D. The distance between successive lines of weakening in the paper being folded determines the diameter of gear 81. Gear 81 is detachably fixedly mounted on and rotates shaft 23A.

The schematic diagram in FIG. 7 illustrates the synchronous relationship of the chute 19, beaters 41 and spirals 42 as they respectively move in the directions indicated by arrows E, F and G. When lines of weakening formed in the strip of paper 8 are distributed in opposite directions by chute 19, the distributed paper is compressed by beaters 41 and spirals 42 to form folds 88. Beaters 41 ideally strike the upper surface of material paper 8 one-half to two inches behind the lines of weakening along which the paper is folded. The chute and beaters are synchronized such that when the chute is at the midpoint of its oscillation arc, surfaces 89 and 90 of beaters 41 are in the positions depicted in FIG. 5. Similarly, when chute 19 and beaters 41 are in the positions illustrated in FIG. 5, a given point on the periphery of each spiral 42 is in a particular position with respect to chute 19 and beaters 41.

In operation, when apparatus 113 is in the operative position illustrated in FIG. 3, paper strip 8 travels through the apparatus of FIG. 1 in the direction of travel indicated by arrows T to guide roller 15, and from guide roller 15 through opening 29A into apparatus 113 as indicated by dashed line 113A in FIG. 1. Paper strip 8 entering apparatus 113 is creased along transverse lines of weakening formed in strip 8 by perforating means 13. Variator roller 12 is displaced upwardly or downwardly as indicated by arrow V to retard or advance paper strip 8 entering perforating means 13. Printing drum 11 repeatedly imprints business formats 120 at generally equal intervals along paper strip 8. As shown in FIG. 2, the lines of weakening 121 formed in strip 8 by perforator means 13 are intermediate each successive pair of business formats 120 imprinted on strip 8. If a line of weakening 121 is too near or too far from a business format 120, then variator roller 12 can be lowered to advance the position of the lines of weakening on paper strip 8 in the direction of arrow W in FIG. 2. Raising roller 12 retards the position of lines of weakening on strip 8 in a direction opposite that of arrow W. Raising and lowering variator roller 12 also advances and retards the position of lines of weakening 121 passing through chute 19 in creasing apparatus 113. Consequently, in the system of the invention it is necessary to have means on apparatus 113 for advancing or retarding the time at which lines of weakening pass through the mouth of chute 19. As earlier noted, when chute 19 distributes successive transverse lines of weakening in opposite directions, beaters 41 and spirals 42 function to compress and crease the distributed paper along the lines of weakening. Ideally, the beaters strike the upper surface of distributed paper strip 8 one-half to two inches behind the lines of weakening or folded edge of the paper or other material. At various operational speeds the operational characteristics of the paper folding mechanisms may vary and the points at which the beaters strike the upper surface of paper strip 8 tend to travel to a position outside the preferred one-half to two inch range. In particular, at high operational speeds the chute is elastically deformed during its oscillation. This tends to retard travel of paper through the chute and cause lines of weakening to pass through the mouth of the chute at the improper time. Adjustment of variator roller 12 can also cause lines of weakening in paper 8 to pass through the mouth of chute 19 at unproper times. When handle 40 is turned, shaft 23B is rotated and retarded or advanced with respect to shaft 23A so that the timing of the chute, beaters, and spirals is simultaneously retarded or advanced with respect to the feed roller 17 such that the lines of weakening are again distributed equidistant from the center of the arc of oscillation followed by the mouth of chute 19. Differential timing mechanism 24 permits this retarding or advancing of lines of weakening to be accomplished while maintaining the synchronous relationship of the chute, beaters and spirals.

If it is not desired to utilize the creasing apparatus 113, then mechanism 115 is disengaged and apparatus 113 pivoted about rod 114 to the position of FIG. 2 and paper strip 8 traveling through the apparatus of FIG. 1 is directed from guide roller 15 to take-up roll 16 as shown in FIG. 2. Variator roller 12 can again be adjusted to retard or advance paper strip 8 passing into perforating means 13.

The presently preferred construction of differential unit 24 is illustrated in FIG. 8 of my copending application, Ser. No. 115, 705, filed 1/28/80 now U.S. Pat. No. 4,522,619, said patent being incorporated herein by reference.

Having described my invention in such terms as to enable those persons skilled in the art to which it pertains to understand and practice it, and having identified the presently preferred embodiment thereof, I claim:

1. Apparatus for imprinting an elongate strip of paper moving along a path of travel through the apparatus, said paper strip having a pair of parallel elongate peripheral edges, said apparatus including (a) primary frame means;

(b) a roll of paper rotatably mounted on said frame means to supply said strip of paper moving through said apparatus;

(c) at least one drum rotatably mounted on said frame means for contacting and imprinting said strip of paper moving through said apparatus;

(d) roller means rotatably mounted on said frame means and adapted to contact and form transverse, parallel lines of weakening at spaced intervals along said paper strip moving through said apparatus;

(e) a take-up roller for receiving said paper strip after said strip has contacted and moved past said imprinting drum and said roller means;

(f) a plurality of guide rollers rotatably mounted on said frame means and contacted by said strip of paper moving through said apparatus, said guide rollers, imprinting drum and roller means generally defining said path of travel of said strip of paper from said supply roll through said apparatus, one of said guide rollers being positioned along said path of travel intermediate said roller means and take-up roller, said paper strip moving through said apparatus along said path of travel within an envelope generally bounded by a pair of imaginary vertical parallel planes each intersecting one of said elongate peripheral edges of said paper strip;

(g) secondary frame means operatively associated with said primary frame means;

(h) an oscillating chute mounted on said secondary frame means for alternately distributing at least some of said lines of weakening in said paper strip in substantially opposite directions;

(i) a feed roller carried on said secondary frame means for dispensing said continuous strip of paper into said oscillating chute;

(j) folding means carried on said secondary frame means and operatively associated with said oscillating chute for urging said paper distributed by said chute into a folded condition, said folding means including (i) spirals shaped and dimensioned to receive and carry away from said oscillating chute creased edges of paper distributed by said chute, said spirals being independently adjustable prior to the operation of said apparatus, and (ii) beaters for periodically tamping said paper distributed by said chute, said beaters assisting in the folding and positioning of said paper and being independently adjustable prior to the operation of said apparatus, said spirals and beaters moving in synchronous relationship with said chute during the operation thereof, (k) a support surface mounted on said apparatus for receiving paper dispensed by said spirals and beaters;

(l) paper stops mounted on said secondary frame means and positioned above said support surface, each of said paper stops having at least one upstanding face for contacting and preventing the lateral travel of creased edges of paper distributed by said chute;

(m) first gear train means carried on said primary frame means for transmitting motive power to at least one of the group consisting of said guide rollers, said take-up roller, said imprinting drum, and said roller means mounted on said primary frame means to draw said paper strip from said supply roller through said apparatus and along said path of travel;

(n) power means to drive said first gear train means;

(o) second gear train means carried on said secondary frame means for driving and transmitting motive power to said feed roller, oscillating chute and folding means such that generally synchronized movement thereinbetween is maintained, a portion of said gear train means actuating said chute and folding means without actuating said feed roller;

(p) means for driving said second gear train means;

(q) means carried on said secondary frame means for simultaneously adjusting said oscillating chute and said folding means in relation to said feed roller while maintaining said generally synchronous movement between said chute and folding means, said adjustment means including (i) at least one driven shaft positioned along said second gear train means and transmitting motive power to said portion of said second gear train means actuating said oscillating chute and said folding means, said drive shaft having a first segment and a second segment, and (ii) a differential unit positioned between and interconnecting said first shaft segment and said second shaft segment for rotating and advancing and retarding said first shaft with respect to said second shaft so that said synchronous movement of said oscillating chute and said folding means may be adjusted in relation to said feed roller when said second gear train means is driving said feed roller, oscillating chute, and folding means;

said secondary frame means connected to said primary frame means for movement between at least two operative positions, (r) a first operative position with said feed roller generally parallel to said guide rollers, supply roll and take-up roller, and positioned to receive said paper strip from said guide roller positioned intermediate said roller means and said take-up roller such that said paper strip received by said feed roller generally lies within said envelope bounded by said first and second parallel imaginary planes; and, (s) a second operative position with said feed roller and secondary frame means generally displaced to a position outside of said envelope bounded by said first and second parallel imaginary planes;

said paper strip moving through said apparatus being directed from said guide roller positioned intermediate said roller means and said take-up roller to (t) said feed roller and through said chute and folding means when said secondary frame means is in said first operative position; and, (u) said take-up roller when said secondary frame means is in said second operative position.

* * * * *